US009708813B2

(12) United States Patent
Mochizuki et al.

(10) Patent No.: US 9,708,813 B2
(45) Date of Patent: Jul. 18, 2017

(54) BEAM REINFORCING METALLIC MATERIAL AND BEAM REINFORCING STRUCTURE

(71) Applicant: SENQCIA CORPORATION, Tokyo (JP)

(72) Inventors: Hisatomo Mochizuki, Tokyo (JP); Takuya Aoki, Funabashi (JP); Hidenori Tanaka, Funabashi (JP)

(73) Assignee: SENQCIA CORPORATION, Tokyo (JP)

( * ) Notice: Subject to any disclaimer, the term of this patent is extended or adjusted under 35 U.S.C. 154(b) by 0 days.

(21) Appl. No.: 14/753,702

(22) Filed: Jun. 29, 2015

(65) Prior Publication Data

US 2016/0002925 A1 Jan. 7, 2016

(30) Foreign Application Priority Data

Jul. 1, 2014 (JP) ..... 2014-135697

(51) Int. Cl.
*E04C 3/08* (2006.01)
*E04G 23/02* (2006.01)
(Continued)

(52) U.S. Cl.
CPC ..... *E04C 3/08* (2013.01); *E04C 3/083* (2013.01); *E04G 23/0244* (2013.01); *E04C 2/423* (2013.01); *E04C 2003/0452* (2013.01)

(58) Field of Classification Search
CPC . E04C 3/08; E04C 2/425; E04C 2/423; E04C 2003/0452; E04C 3/065
See application file for complete search history.

(56) References Cited

U.S. PATENT DOCUMENTS 2,452,410 A 10/1948 Wiegel
3,101,272 A * 8/1963 Setzer ..... E04C 3/10 280/781
(Continued)

FOREIGN PATENT DOCUMENTS

JP 2003-193619 A 7/2003
JP 2007-162244 A 6/2007
(Continued)

OTHER PUBLICATIONS

Apr. 1, 2016 Office Action issued in U.S. Appl. No. 14/753,821.
Jul. 29, 2016 Office Action issued in U.S. Appl. No. 14/753,821.
Dec. 13, 2016 Office Action issued in U.S. Appl. No. 14/753,821.

*Primary Examiner* — Babajide Demuren
(74) *Attorney, Agent, or Firm* — Oliff PLC

(57) ABSTRACT

A beam reinforcing metallic material includes a welding surface, a counter-flange-part surface, a contacting surface, a protrusion, and the like. The beam reinforcing material is a member that is made of metal such as steel for example. The beam reinforcing metallic material is not plate shaped but has a three dimensional shape. More particularly, the cross-sectional shape varies from the edge parts toward the center part in longitudinal direction. The cross section (cross-sectional area) of the center part of the beam reinforcing metallic material in longitudinal direction is larger than the cross sections (cross-sectional areas) of the both end parts. Increasing the cross-sectional area of the vicinity of the center part of the beam reinforcing metallic material allows the part that receives maximum stress to securely obtain the flexural strength when the beam reinforcing metallic material is fixed to the beam.

6 Claims, 9 Drawing Sheets

(51) Int. Cl.
*E04C 2/42* (2006.01)
*E04C 3/04* (2006.01)

(56) References Cited

U.S. PATENT DOCUMENTS

| | | | | | |
|---|---|---|---|---|---|
| 3,123,978 | A | * | 3/1964 | Pruyn | E02D 5/72 405/254 |
| 3,126,709 | A | * | 3/1964 | Dougherty | E02D 5/72 405/251 |
| 3,890,757 | A | * | 6/1975 | Lamer | B66C 23/701 52/118 |
| 4,003,168 | A | * | 1/1977 | Brady | B66C 23/701 212/347 |
| 4,014,089 | A | | 3/1977 | Sato et al. | |
| 4,129,974 | A | * | 12/1978 | Ojalvo | E04C 3/06 29/897.35 |
| 5,519,977 | A | | 5/1996 | Callahan et al. | |
| 6,691,487 | B2 | | 2/2004 | Daudet | |
| 7,293,394 | B2 | | 11/2007 | Davis | |
| 2005/0144892 | A1 | | 7/2005 | Strickland et al. | |
| 2009/0148660 | A1 | | 6/2009 | Cooper et al. | |

FOREIGN PATENT DOCUMENTS

| | | | | |
|---|---|---|---|---|
| JP | 2007162244 | A | * | 6/2007 |
| JP | 2009-167615 | A | | 7/2009 |
| JP | 2011-063931 | A | | 3/2011 |
| JP | 2011063931 | A | * | 3/2011 |
| JP | 2013-014956 | A | | 1/2013 |
| JP | 2013014956 | A | * | 1/2013 |

* cited by examiner

BEAM REINFORCING METALLIC MATERIAL AND BEAM REINFORCING STRUCTURE

TECHNICAL FIELD OF THE INVENTION

This invention relates to a metallic material and the like that is connected to a beam and reinforces the beam which constitutes a building structure and has a through hole.

BACKGROUND OF THE INVENTION

It is conventional to form a through hole in a beam of a building structure to let pipes and wires to pass through the beam. In this case, the flexural strength of the beam decreases because of the through hole. To prevent this decrease in the flexural strength of the beam, a beam reinforcing metallic material is connected to the beam, reinforcing the same.

As such a beam reinforcing metallic material, there is a method, for example, in which a plate being shaped to fit along the through hole is connected around the through hole (Patent Document 1 for example).

RELATED ART

Patent Documents

[Patent Document 1] Japanese Unexamined Patent Application Publication No. 2003-193619 (JP-A-2003-193619)

SUMMARY OF THE INVENTION

Problems to be Solved by the Invention

However, a method using a plate-like member requires a larger plate-like member than the predetermined size in order to reinforce the periphery of the through hole and cannot be adapted to cases in which the through hole is eccentrically positioned close to one of the flange sections and the like.

Also, since these plate-like members have a constant thickness, if the thickness is set to securely obtain the flexural strength for the part that requires the reinforcement the most, the other parts of the beam are then reinforced excessively, resulting in increase of weight and cost.

In contrast, there is a ring-shaped beam reinforcing member which is connected to the through hole. However, to arrange a ring-shaped beam reinforcing member to the through hole, it is necessary to enlarge the through hole to that extent. Also, a reinforcing member of larger size may be required to securely obtain the sufficient flexural strength.

The present invention was achieved in view of such problems. Its object is to provide a beam reinforcing metallic material and the like that can efficiently reinforce a beam.

Means for Solving Problems

To achieve the above object, a first invention is a beam reinforcing metallic material that reinforces a beam having a through hole and comprises a contacting surface that contacts a web of the beam, a welding surface that is welded to the web, and a counter-flange-part surface that approximately faces the welding surface and faces the flange part of the beam, wherein the cross-section of the center part in longitudinal direction is larger than the cross-sections of the both end parts.

It is preferable that the counter-flange-part surface is approximately in a straight line to the longitudinal direction, the welding surface is bent or curved, and the width of the center part in the longitudinal direction is larger than the widths of the both end parts.

A mark that shows the direction of the counter-flange-part surface may be provided.

The mark may be a protrusion provided on the counter-flange-part surface.

The protrusion may be formed up to the edge part of the contacting surface, or the protrusion may not be formed up to the edge part of the contacting surface and a gap may be formed between the lower edge of the protrusion and the edge part of the contacting surface.

A welding-range specifying part that specifies a range of welding may be provided on the welding surface.

The welding-range specifying part may be an angle-varying part on the cross-section in the width-direction.

According to the first invention, since the beam reinforcing metallic material has a varying cross sectional shape in which the cross sectional area at the center part is large, it is possible to efficiently reinforce only the part that requires the most flexural strength and weight-reduction can be achieved as well. Also, since the cross-sectional area (thickness for example) of the required part is large, the entire size (installation area) can be reduced. Therefore, it is even possible to install the beam reinforcing metallic material in a part in which the gap between the through hole and the flange part is small.

Also, bending or curving the welding surface of the beam reinforcing metallic material so to enlarge the width of the center part makes it easier to weld compared to the cases in which a simple rectangular shape or a ring shape corresponding to a through hole is used. For example, if a rectangular plate member is used, it is necessary to weld all four sides of the plate. However, in the present invention, welding only three sides is sufficient. Also, welding operation is easy since the three sides do not interchange to one another but are smoothly continuous so that the difference in welding direction depending on the parts is small.

Also, providing a mark showing the direction of the counter-flange-part surface makes it impossible to mistake the installing direction or the installing surface of the beam reinforcing metallic material. On this occasion, visibility is excellent if the mark is a protrusion, and the contacting surface is not mistakenly arranged in place of the counter-flange-part surface.

Also, if the protrusion is formed up to the edge part of the contacting surface (in other words, if the protrusion is formed over the whole height of the counter-flange-part surface), the lower edge of the protrusion can be butted to the fillet shaped edge part on the boundary between the web part and the flange part. Therefore, the beam reinforcing metallic material can be installed at a predetermined distance from the fillet-shaped edge part. This facilitates the positioning of the beam reinforcing metallic material.

Also, if the protrusion is not formed up to the edge part of the contacting surface and a gap is formed between the lower edge of the protrusion and the edge part of the contacting surface (in other words, if the protrusion is formed from the upper part to the middle of the counter-flange-part surface), the protrusion can be butted to the flange part with the lower end of the protrusion not interfering with the fillet shape on the boundary between the web part and the flange part. Therefore, the beam reinforcing metallic material can be installed at a predetermined distance from the flange part without an influence of the fillet shape. This facilitates the positioning of the beam reinforcing metallic material.

Also, providing a welding-range specifying part showing the welding range on the welding surface makes it easy to grasp the necessary welding margin. Therefore, it is possible to suppress unnecessary welding as well as to prevent insufficient welding and the like.

Also, visibility is excellent if the welding-range specifying part is an angle varying part on the cross section in the width direction. Also, if the beam reinforcing metallic material is molded by forging and the like, the drafted tapered part can be used as the welding-range specifying part by setting the fitting section of the mold to the position of the welding-range specifying part.

A second invention is a beam reinforcing structure using the beam reinforcing metallic material according to the first invention, wherein, wherein a pair of the beam reinforcing metallic material is located on a beam having a web with a through hole formed thereon so that the counter-flange-part surfaces of the beam reinforcing metallic materials in the vicinity of each of the flange parts, which are above and below the through hole, face each of the flange parts respectively and the contacting surface is in contact with the web, and the web and the beam reinforcing metallic material are welded and fixed with the welded surface.

According to the second invention, it is possible to reinforce a beam efficiently.

Effects of the Invention

The present invention can provide a beam reinforcing metallic material and the like that can efficiently reinforce a beam.

BRIEF DESCRIPTION OF DRAWINGS

FIG. 3 (*b*) is a plan view showing the beam reinforcing metallic material 1.

FIG. 4 (*b*) is a cross sectional view of D-D line in FIG. 3 (*b*).

DESCRIPTION OF SOME EMBODIMENTS

Figure 1:
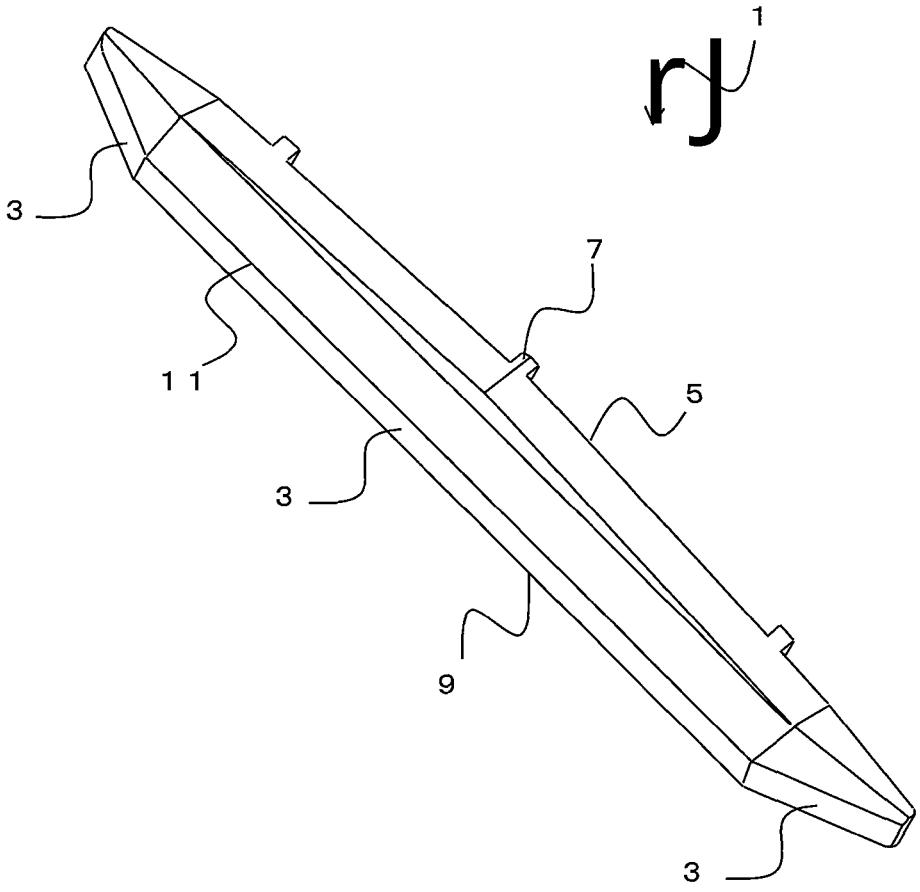
FIG. 1 is an upper perspective view showing a beam reinforcing metallic material 1.
Figure 2:
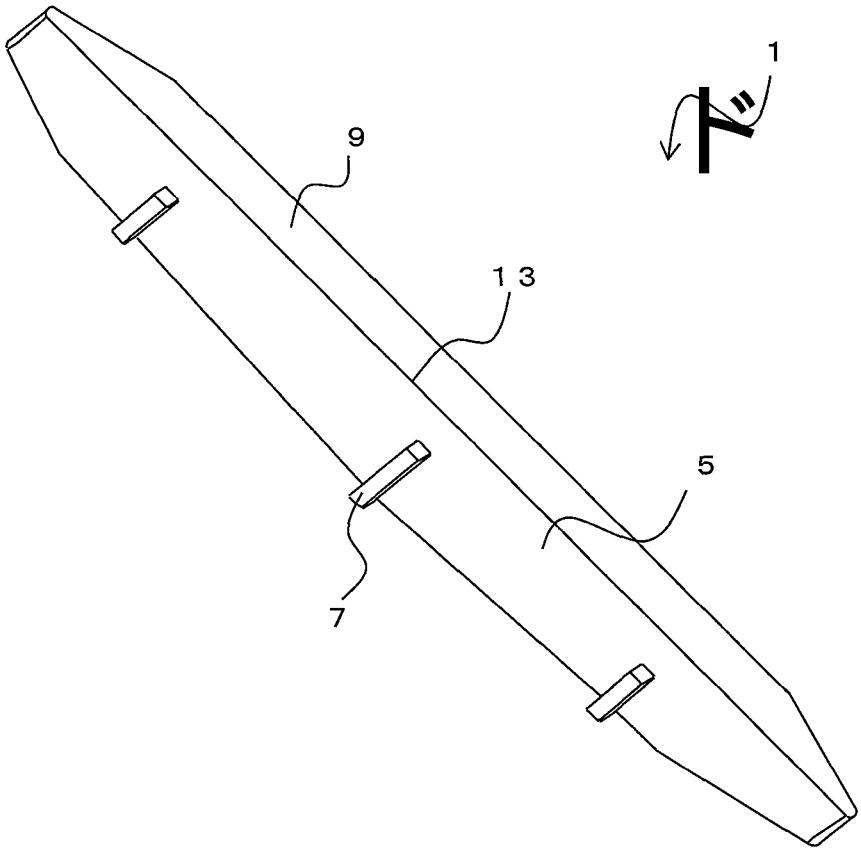
FIG. 2 is a lower perspective view showing the beam reinforcing metallic material 1.
Figure 3A:
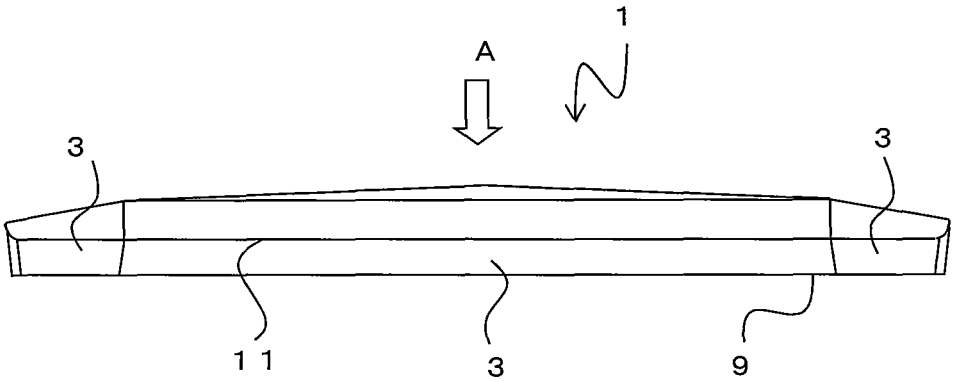
FIG. 3 (*a*) is a front view showing the beam reinforcing metallic material 1.
Figure 3B:
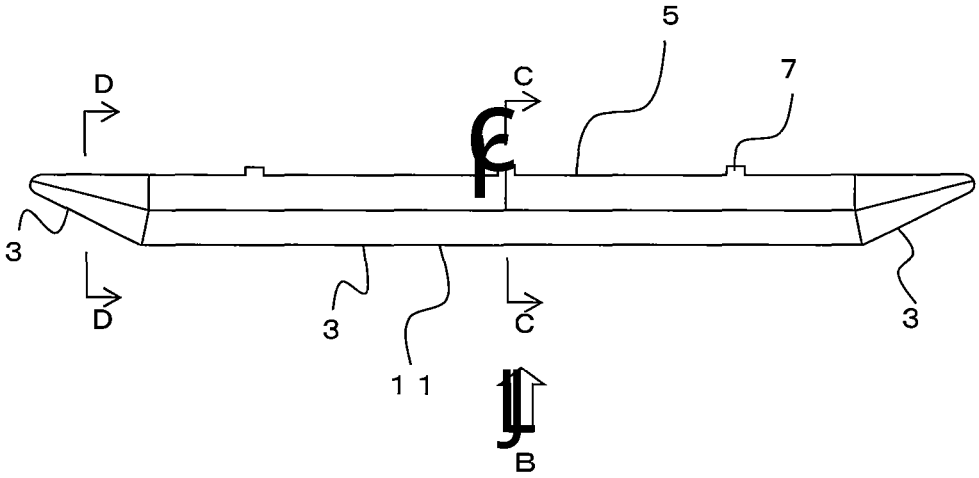

Hereinafter, a beam reinforcing metallic material 1 according to a first embodiment of the present invention will be described. FIG. 1 is an upper perspective view and FIG. 2 is a lower perspective view showing the beam reinforcing metallic material 1. FIG. 3 (*a*) is a front view showing the beam reinforcing metallic material 1 (a view from arrow B in FIG. 3 (*b*)) and FIG. 3 (*b*) is a plan view showing the beam reinforcing metallic material 1 (a view from arrow A in FIG. 3 (*a*)).

The beam reinforcing metallic material 1 has a welding surface 3, a counter-flange-part surface 5, a contacting surface 9, protrusions 7, and the like. The beam reinforcing metallic material 1 is a member made of metal such as steel materials and stainless steel. The beam reinforcing metallic material 1 is not plate shaped but has a three dimensional shape. More particularly, the cross-sectional shape varies from the edge parts toward the center part in the longitudinal direction preferably. Details of the cross-sectional shapes will be described later.

The contacting surface 9 is a surface that contacts a web part of a beam. Therefore, the contacting surface 9 is formed to be a perfectly flat surface.

The counter-flange-part surface 5 is a part that faces a flange part of a beam and is formed in an approximately straight line. The protrusion 7 is formed on the counter-flange-part surface. Although the beam reinforcing metallic material 1 with total of three protrusions 7, of which the one is formed at the center in the longitudinal direction and the other two are formed on both sides thereof, is shown in the example drawings, the location and the number of the protrusions 7 are not limited to the examples shown.

The protrusion 7 functions as a mark showing the direction of the counter-flange-part surface 5. For example, if no mark such as the protrusion 7 is formed, it is possible that the counter-flange-part surface 5 is mistakenly taken as the contacting surface 9 that is to be in contact with a web. It is also likely to locate the counter-flange-part surface 5 in the direction opposite to the flange part. Providing the protrusion 7 clarifies that the protrusion 7 is to be located toward the direction of the flange part, thus preventing mistakes in installation.

If the protrusion 7 is formed at least at the center in the longitudinal direction, the center protrusion 7 can be used to grasp the center position of the beam reinforcing metallic material 1. Therefore, it is possible to easily grasp the installation position of the beam reinforcing metallic material 1 against the through hole in its longitudinal direction.

The mark to grasp the directions and the like of the beam reinforcing metallic material 1 is not necessarily be the protrusion 7. Other structures (such as dents, coloring, or marking-off) may be used as long as the direction can be grasped.

The welding surface 3 approximately faces the counter-flange part surface 5 and is a part that is welded to a web part of a beam. As shown in FIG. 3 (*b*), the welding surface 3 has a bent section in part. A curved section may be formed instead of the bent section and even the whole welding surface 3 may be in a curved shape.

In the example shown in the drawing, the beam reinforcing metallic material 1 is substantially a trapezoid in a plan view. That is, the welding surface 3 is formed by three sides. Since the welding part may have only three sides in the present embodiment, it is unnecessary to weld over the whole circumference as in welding a plate-like member. In addition, the two sides on either sides of the welding surface 3 are not formed perpendicular to the center side of the welding surface 3 but are formed in gentle tapered shapes. Therefore, change in the welding direction is small, which makes the welding operation easy to perform.

Figure 4A:
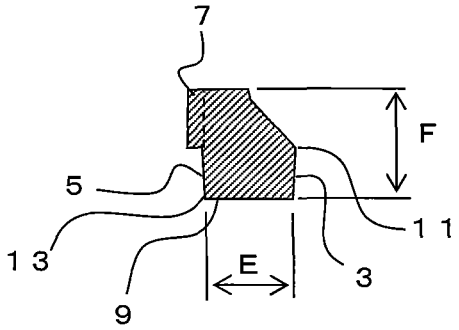
FIG. 4 (*a*) is a cross sectional view of C-C line in FIG. 3 (*b*).
Figure 4B:
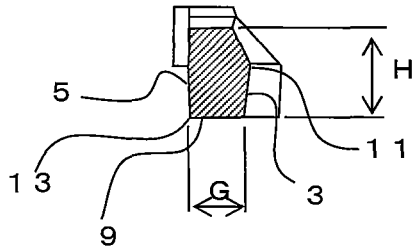

FIG. 4 (*a*) is a cross-sectional view of C-C line in FIG. 3 (*b*) (the vicinity of the center in longitudinal direction) and FIG. 4 (*b*) is a cross-sectional view of D-D line in FIG. 3 (*b*) (the vicinity of the end part in longitudinal direction). As described above, the beam reinforcing metallic material 1 has a cross-sectional shape that varies in longitudinal direction. Hereinafter, the distance between the welding surface 3 and the counter-flange part surface 5 of the beam reinforcing metallic material 1 (the length of the contacting surface 9) is called as a width of the beam reinforcing metallic material 1, and the distance between the contacting surface 9 and the upper surface (the length of the counter-flange-part surface 5) is called as a height when the contacting surface 9 is a lower surface.

The cross section (cross-sectional area) of the center part in longitudinal direction of the beam reinforcing metallic material 1 is larger than the cross section (cross-sectional area) of the both end parts. More particularly, the width E of the center part in the longitudinal direction of the beam reinforcing metallic material 1 is larger than the width G of the both end parts. Also, the height F of the center part in longitudinal direction of the beam reinforcing metallic material 1 is larger than the height H of the both end parts.

Increasing the cross-sectional area of the vicinity of the center part of the beam reinforcing metallic material 1 allows the part that receives maximum stress when the beam reinforcing metallic material 1 is fixed to the beam to securely obtain the strength. Also, on this occasion, since the strength necessary for the beam reinforcing metallic material 1 decreases as leaving away from the center, making the cross section smaller toward the end parts corresponding to this can suppress the increase in weight and cost.

Here, the protrusion 7 is not formed over the whole height of the counter-flange-part surface 5, but is formed on a part thereof. More specifically, if a side on the border between the counter-flange-part surface 5 and the contacting surface 9 is an edge part of the contacting surface 13, the protrusion 7 is not formed from upper part of the counter-flange-part surface 5 to the edge part of the contacting surface 13 and a gap is formed between the lower end of the protrusion 7 and the edge part of the contacting surface 13.

Also, on the cross section of the beam reinforcing metallic material 1 in the width direction, an angle varying section 11 is provided on the upper part of the welding surface 3. The angle varying section 11 is a section in which an angle between the welding surface 3 and the upper part thereof varies on the cross section. The angle varying section 11 functions as a welding-range specifying part. That is, required welding strength can be securely obtained by welding up to the position to which the angle varying section 11 is covered.

The welding-range specifying part is not necessarily the angle varying part 11, but may be in other structures such as coloring, level difference, and roughness change.

Also, if the beam reinforcing metallic material 1 is manufactured by using metal mold in forging and the like, draft taper is necessary for pulling out from the metal mold and this draft taper can be used as the angle varying section 11. For example, by setting the angle varying section 11 to the fitting section of the mold, the angle varying section 11 can be formed on the border between the draft taper of the lower part of the welding surface 3 and the opposite taper on the upper part thereof.

Figure 5:
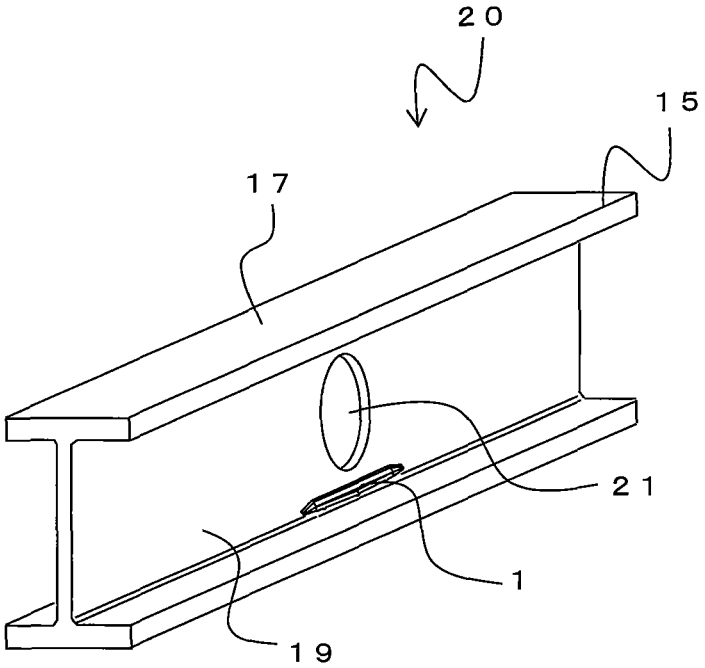
FIG. 5 is a perspective view showing a beam reinforcing structure 20.

Next, a beam reinforcing structure 20 using the beam reinforcing metallic material 1 will be described. FIG. 5 is a perspective view and FIG. 6 is a front view of the beam reinforcing structure 20.

A beam 15 is an H-shaped steel having flange parts 17 on the upper and lower part of a web part 19. A through hole 21 is formed in the web part 19 to let pipes and the like pass through. A pair of the beam reinforcing metallic materials 1 is located at a position away from the through hole 21, along the upper and lower flange parts 17. The center position of the through hole 21 is approximately corresponds with the center position of the beam reinforcing metallic material 1 in longitudinal direction. Also, the beam reinforcing metallic material 1 is longer than the diameter of the through hole 21.

Figure 6:
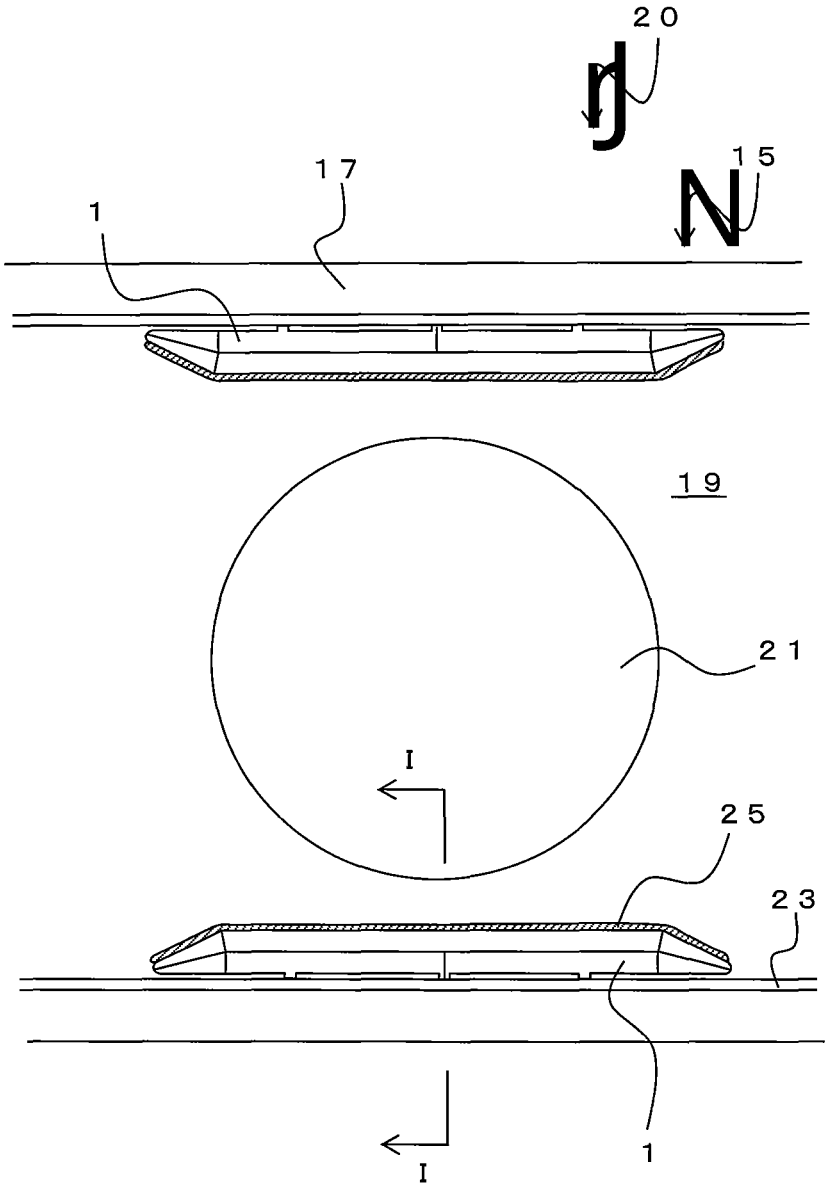
FIG. 6 is a front view showing the beam reinforcing structure 20.
Figure 7:
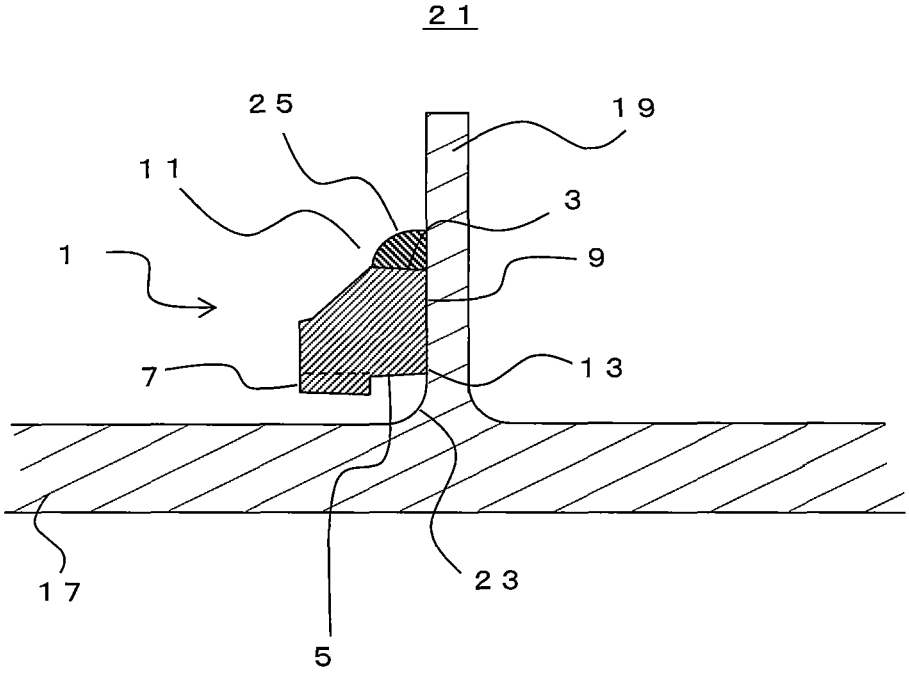
FIG. 7 is a cross sectional view of I-I line in FIG. 6.

FIG. 7 is a cross-sectional view of I-I line in FIG. 6. The beam reinforcing metallic material 1 is located in the direction in which the counter-flange-part surface 5 of the beam reinforcing metallic material 1 faces the flange part 17. Also, the contacting surface 9 contacts with the web part 19 and is fixed to the web part 19 by means of a welded section 25. On this occasion, the welded section 25 is formed up to the height to which the angle varying part 11 is covered.

Here, a fillet section 23 is formed on the border part between the web part 19 and the flange part 17 of the beam 15. The fillet section 23, which is a thickness varying part of the web part 19, is an approximately arc-shaped concave section that gently connects the web part 19 and the flange part 17. There is a case in which a weld bead is formed instead of the fillet part 23, and in this case, its shape becomes an approximately arc-shaped convex shape. Although the fillet section 23 will be described below, it is similar in the case of a welded section.

The effects of enhancing the flexural strength is larger if the beam reinforcing metallic material 1 is closer to the flange part 17. Therefore, the beam reinforcing metallic material 1 is located at a position that is away from the through hole 21 and in the vicinity of the flange part 17.

On the other hand, as described above, the fillet section 23 is formed in the vicinity of the border part between the web part 19 and the flange part 17. If the beam reinforcing metallic material 1 is on the fillet section 23, the beam reinforcing metallic material 1 rides over the fillet section 23 so that the contacting surface 9 may separate from the web part 19. Therefore, the beam reinforcing metallic material 1 is installed at a position in which the beam reinforcing metallic material 1 does not ride over the fillet section 23. That is, the beam reinforcing metallic material 1 is located at a position in which the edge part of the contacting surface 13 is located on the side of the through hole before the fillet section 23.

As described above, according to the present embodiment, the beam 15 having a through hole 21 can be efficiently reinforced. Particularly, since the beam reinforcing metallic material 1 is formed so that the cross section of the center part thereof is large, the strength for the required part can be securely obtained as well as achieving weight reduction. Also, since sufficient strength can be secured by varying the thickness in this way without increasing the width, the installation is possible even the distance between the flange part 17 and the through hole 21 is small.

Also, it is unnecessary to enlarge the through hole 21 more than necessary because no ring-shaped member is located at the through hole 21.

Also, the flexural strength of the beam 15 can be efficiently improved because the beam reinforcing metallic material 1 is located in the vicinity of the flange part 17 away from the through hole.

Also, it is unlikely to mistake the installation direction or the installation surface of the beam reinforcing metallic material 1 because the protrusion 7 that shows the direction of the counter-flange-part surface 5 is formed.

Also, since the welding surface is formed to be bent, the beam reinforcing metallic material 1 can be fixed to the web part 19 by welding the three sides. Therefore, welding operation is easy.

Also, since the welding range is specified by the angle varying section, it is possible to suppress insufficient welding and cost increase due to excessive welding.

Figure 8:
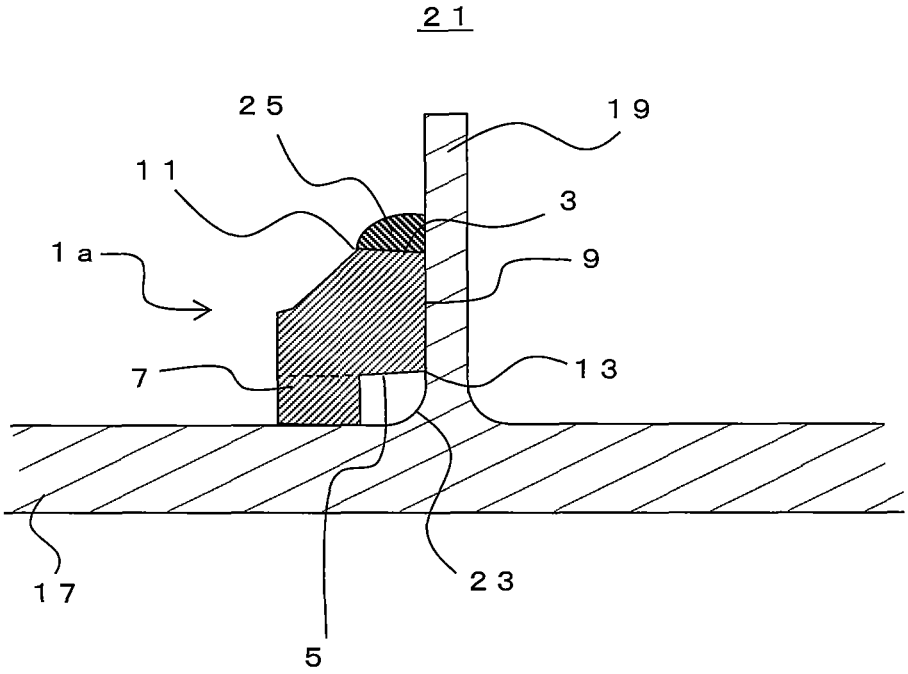
FIG. 8 is a cross sectional view showing second embodiment.

Next, a second embodiment of the present invention will be described. FIG. 8 shows a beam reinforcing metallic material 1*a* according to the second embodiment, corresponding to FIG. 7. In the descriptions below, the same numerals will be used for the same structures as in the beam reinforcing metallic material 1, and redundant explanations will be omitted.

The beam reinforcing metallic material 1*a* has almost the same structure as the beam reinforcing metallic material 1 except that the length of the protrusion 7 (protruded margin) is different. The protruded margin of the protrusion 7 of the beam reinforcing metallic material 1*a* is slightly larger than the range of the fillet section 23 formed. Therefore, to install the beam reinforcing metallic material 1*a*, the protrusion 7 is brought into contact with the flange part 17 so that the positioning of the beam reinforcing metallic material 1*a* is easy. On this occasion, the beam reinforcing metallic material 1*a* does not ride over the fillet section 23.

The same effects can be obtained as the beam reinforcing metallic material 1 with the beam reinforcing metallic material 1*a*. Also, since the length of the protrusion 7 corresponds to the size of the fillet section 23, it is possible to position the beam reinforcing metallic material 1*a* with certainty by butting the protrusion 7 to the flange part 17. Therefore, workability of installation is excellent.

Figure 9:
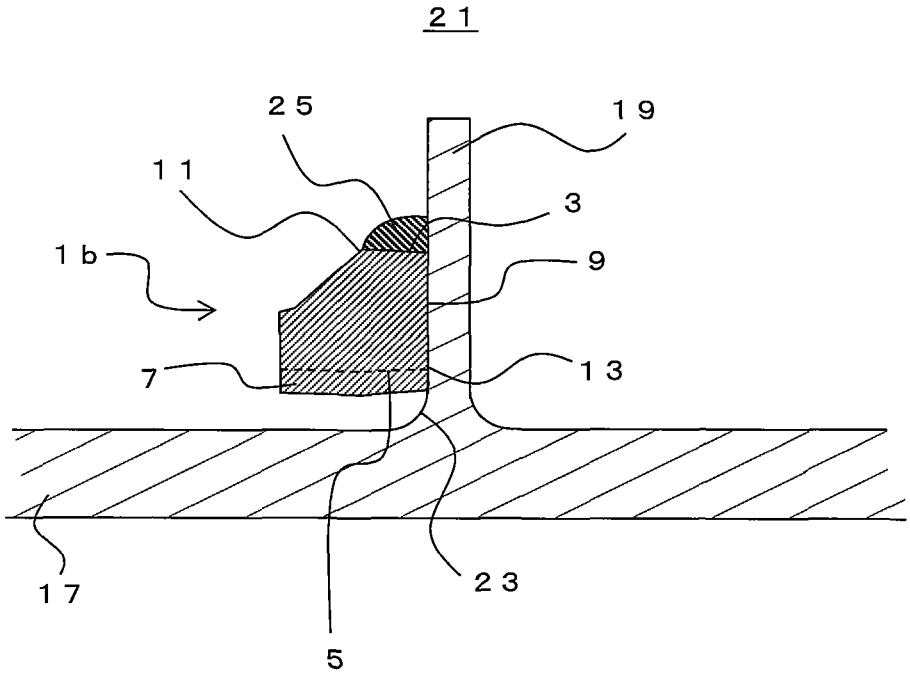
FIG. 9 is a cross sectional view showing third embodiment.

FIG. 9 is a cross-sectional view of a beam reinforcing metallic material 1*b* according to a third embodiment of the present invention. The beam reinforcing metallic material 1*b* has almost the same structure as the beam reinforcing metallic material 1 except that the protrusion 7 is formed up to the edge part of the contacting surface 13.

To install the beam reinforcing metallic material 1*b*, the lower tip end of the protrusion 7 is located along the edge part of the fillet section 23. By installing this way, the edge part of the contacting surface 13 is located at a predetermined distance (equivalent to the length of the protrusion 7) away from the fillet section 23. Therefore, the contacting surface 9 does not ride over the edge part of the contacting surface 13.

To locate the tip of the protrusion 7 along the edge part of the fillet section 23, the beam reinforcing metallic material 1*b* is slid from the side of the through hole 21 until the tip of the protrusion 7 is butted to the fillet section 23 or may be adjusted by visual observation.

By doing this way, the beam reinforcing metallic material 1*b* can be located easily at a position which is a predetermined distance away from the fillet section 23. For example, there are cases in which the fillet section 23 is not perfectly straight, and, if the contacting surface 9 is located to be in contact with the fillet section 23, it is likely that a part of the beam reinforcing metallic material 1*b* rides over the fillet section 23. However, if the beam reinforcing metallic material 1*b* is away from the fillet section 23 with the predetermined distance, the influence from this can be eliminated. Also, chamfering the edge part of the protrusion 7 prevents the contacting surface 9 from rising even if the protrusion 7 rides slightly over the vicinity of the edge part of the fillet section 23.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

DESCRIPTION OF NOTATIONS

1, 1*a*, 1*b* . . . beam reinforcing metallic material
3 . . . welding surface
5 . . . counter-flange-part surface
7 . . . protrusion
9 . . . contacting surface
11 . . . angle varying section
13 . . . edge part of the contacting surface
15 . . . beam
17 . . . flange part
19 . . . web part
20 . . . beam reinforcing structure
21 . . . through hole
23 . . . fillet section
25 . . . welded section

What is claimed is:

1. A beam reinforcing metallic material that reinforces a web part and a through hole of a beam, comprising:

a contacting surface that contacts with the web part of the beam;

a welding surface that is welded to the web part; and a counter-flange-part surface that approximately faces the welding surface and faces the flange part of the beam, wherein the beam reinforcing metallic material has a longitudinal direction that is parallel to a longitudinal direction of the beam when the beam reinforcing metallic material is attached to the beam, the cross-section of a center part of the beam-reinforcing metallic material in the longitudinal direction is larger than the cross-sections of both end parts in the longitudinal direction, a plurality of protrusions that show a direction of the counter-flange-part surface are formed on part of the counter-flange-part surface, the protrusions extend in a direction perpendicular to the longitudinal direction, the welding surface comprises a welded part that is welded to the web part, welding-range specifying part that specifies a range of welding, an angle-varying part, and an other part of the welding surface, and the welding range specifying part is an angle varying-part in which an angle between the welded part and the other part of the welding surface varies.

2. The beam reinforcing metallic material according to claim 1, wherein the protrusion is not formed up to the edge part of the contacting surface and a gap is formed between the lower edge of the protrusion and the edge part of the contacting surface.

3. The beam reinforcing metallic material according to claim 1, wherein the protrusion is formed up to the edge part of the contacting surface.

4. A beam reinforcing structure using any of the beam reinforcing metallic material according to claim 1, wherein a pair of the beam reinforcing metallic material is located on a beam having the web part with a through hole formed thereon so that the counter-flange-part surfaces of the beam reinforcing metallic materials in the vicinity of each of the flange parts, which are above and below the through hole, face each of the flange parts respectively and the contacting surface is in contact with the web part; and the web part and the beam reinforcing metallic material are welded and fixed with the welded surface.

5. A beam reinforcing structure using any of the beam reinforcing metallic material according to claim 2, wherein a pair of the beam reinforcing metallic material is located on a beam having the web part with a through hole formed thereon so that the counter-flange-part surfaces of the beam reinforcing metallic materials in the vicinity of each of the flange parts, which are above and below the through hole, face each of the flange parts respectively and the contacting surface is in contact with the web part; and the web part and the beam reinforcing metallic material are welded and fixed with the welded surface.

6. A beam reinforcing structure using any of the beam reinforcing metallic material according to claim 3, wherein a pair of the beam reinforcing metallic material is located on a beam having the web part with a through hole formed thereon so that the counter-flange-part surfaces of the beam reinforcing metallic materials in the vicinity of each of the flange parts, which are above and below the through hole, face each of the flange parts respectively and the contacting surface is in contact with the web part; and the web part and the beam reinforcing metallic material are welded and fixed with the welded surface.

* * * * *